US006703978B2

(12) United States Patent
Tran

(10) Patent No.: US 6,703,978 B2
(45) Date of Patent: Mar. 9, 2004

(54) DUAL TELESCOPIC WHIP ANTENNA

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/128,763

(22) Filed: Apr. 22, 2002

(65) Prior Publication Data

US 2003/0197657 A1 Oct. 23, 2003

(51) Int. Cl.[7] ..... H01Q 1/24
(52) U.S. Cl. ..... 343/702; 343/901
(58) Field of Search ..... 343/901, 900, 343/702; 455/95

(56) References Cited

U.S. PATENT DOCUMENTS 6,310,578 B1 * 10/2001 Ying ..... 343/702
6,359,592 B1 * 3/2002 Chen et al. ..... 343/702

* cited by examiner

*Primary Examiner*—James Clinger

(57) ABSTRACT

A dual telescopic whip antenna, antenna system, and dual telescopic method are provided. The antenna comprises a radiator including a conductive wire, and a first telescoping tube section having a first end to accept the wire and an antenna port at a second end. The radiator also includes a second telescoping tube section having a first end to accept the other end of the wire. The radiator has an extended position length that is approximately equal to the sum of the wire length, the first tube length, and the second tube length. The radiator has a contracted position with the wire length substantially withdrawn in the first and second tubes. In some aspects, the antenna further comprises a chassis with a stopper channel assembly to accept the first and second tubes in the radiator contracted position and to limit the extension of the first tube from the chassis in the radiator extended position. The stopper channel assembly also includes a transmission line terminal that is connected to the antenna port in the radiator extended position.

22 Claims, 3 Drawing Sheets

DUAL TELESCOPIC WHIP ANTENNA

BACKGROUND OF THE INVENTION

1. Field of the Invention

This invention generally relates to wireless communications antennas and, more particularly, to a dual telescopic whip antenna that is especially useful with small portable wireless communication devices.

2. Description of the Related Art

The size of portable wireless communications devices, such as telephones, continues to shrink, even as more functionality is added. As a result, the designers must increase the performance of components or device subsystems while reducing their size, or placing these components in less desirable locations. One such critical component is the wireless communications antenna. This antenna may be connected to a telephone transceiver, for example, or a global positioning system (GPS) receiver.

One antenna design is the patch antenna, which can be incorporated into a wireless device circuit board or the device chassis. However, the close proximity of the chassis to the user can limit the performance of such an antenna. Typically, better communication results are achieved using a whip antenna. Using a wireless telephone as an example, it is typical to use a combination of a helical and a whip antenna. In the standby mode with the whip antenna withdrawn, the wireless device uses the stubby, lower gain helical coil to maintain control channel communications. When a traffic channel is initiated (the phone rings), the user has the option of extending the higher gain whip antenna. Some devices combine the helical and whip antennas. Other devices disconnect the helical antenna when the whip antenna is extended.

The whip antenna has a physical length, when extended, related to the antenna operating frequency. When withdrawn, the whip antenna must fit within the constraints of the wireless device chassis. Therefore, as the wireless device chassis decreases in size, the extended length of conventional whip antennas has necessarily decreased. A shorter whip antenna can be made to operate at the same frequency as longer whip antennas by using higher dielectric constant materials in the antenna fabrication. However, the use of higher dielectric constants makes for a lower gain antenna, and a poorer performing wireless device.

One popular solution to the above-mentioned length problem has been to fabricate the whip antenna as a wire with a telescoping tube section. When the antenna is withdrawn, the wire section is withdrawn into the tube, with the tube being withdrawn into the chassis. When extended, the combination of the wire and tube section define the antenna length.

As mentioned above, one advantage of the whip antenna is a reduced proximity to the human user, who blocks the signal path around the antenna. Whip antenna performance can be further enhanced by further reducing the proximity of the antenna to the user. Safety is another reason for reducing proximity, as there is concern that the proximity of the human head to wireless transmissions may be a health hazard. For these reasons it is desirable to angle the whip antenna from the device chassis when extended, away from the user. When withdrawn, such an angled antenna would necessarily reside in a channel formed through the center of the device chassis (where the electronic components reside), unless the withdrawn antenna can be bent. However, the relatively rigid telescoping tube is not completely flexible. Further, a truly flexible telescoping tube would be easily damaged when the phone is accidentally dropped.

It would be advantageous if a high performance whip antenna could be withdrawn into a compact length using more than one telescoping section.

It would be advantageous if a telescoping whip antenna could be angled away from the device chassis when extended.

SUMMARY OF THE INVENTION

The present invention describes a dual telescope whip antenna. Since two telescoping tubes are used, having approximately half the length of a conventional single tube design, the antenna can be extended at an angle with respect to its withdrawn (contracted) position. That is, the shorter tubes can be inserted into the chassis collection channel at an angle. The antenna has a physical length that is not limited to the chassis collection channel length, or the angle between the antenna withdrawn and extended orientations.

Accordingly, a dual telescopic whip antenna is provided. The antenna comprises a radiator including a conductive wire, and a first telescoping tube section having a first end to accept the wire and an antenna port at a second end. The radiator also includes a second telescoping tube section having a first end to accept the other end of the wire. The radiator has an extended position length that is approximately equal to the sum of the wire length, the first tube length, and the second tube length. The radiator has a contracted position with the wire length substantially withdrawn in the first and second tubes.

In some aspects the antenna further comprises a chassis with a stopper channel assembly to accept the first and second tubes in the radiator contracted position and to limit the extension of the first tube from the chassis in the radiator extended position. The stopper channel assembly also includes a transmission line terminal that is connected to the antenna port in the radiator extended position.

Additional details of the above-described antenna, a wireless communications device dual telescopic antenna system, and a dual telescopic antenna method are described below.

DETAILED DESCRIPTION OF THE PREFERRED EMBODIMENTS

Figure 2:
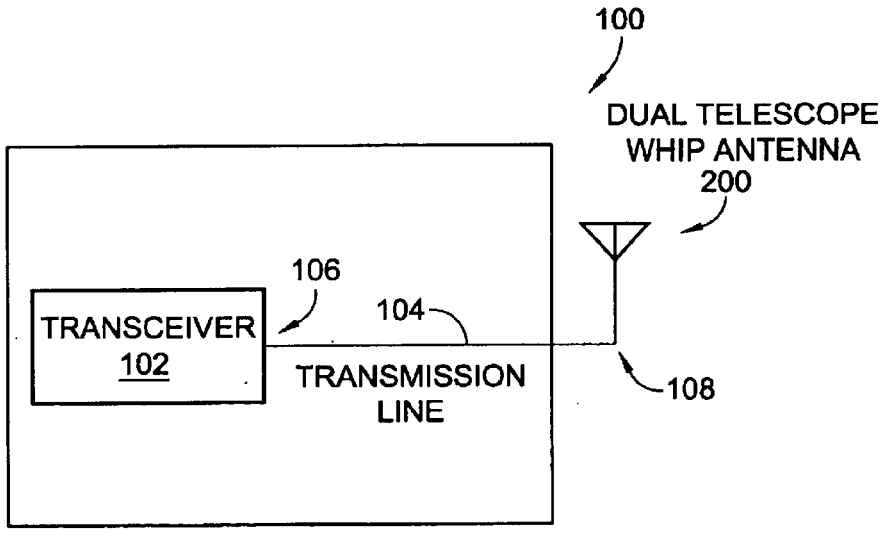
FIG. 2 is a schematic block diagram of the present invention wireless communications device dual telescopic antenna system.

FIG. 2 is a schematic block diagram of the present invention wireless communications device dual telescopic antenna system. The system 100 comprises a wireless communications transceiver 102 having a communications port. A transmission line 104 has a first end 106 connected to the transceiver communications port and a second end 108. The transmission line second end 108 is connected to a dual telescope whip antenna 200. The antenna 200 can be tuned to operate at frequencies such as 824 to 894 megahertz (MHz), or 1850 to 1990 MHz to support wireless telephone communications. The antenna 200 can also be tuned to operate between 1565 and 1585 MHz to support the reception of GPS satellite signals.

Figure 1:
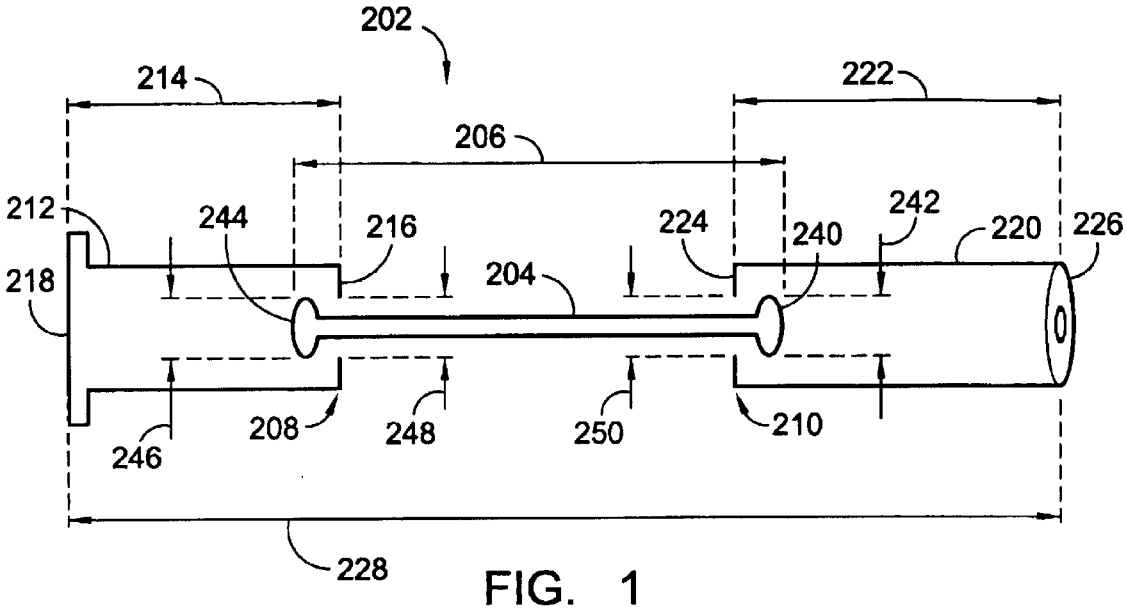
FIG. 1 is a partial cross-sectional view of the present invention dual telescope whip antenna of FIG. 2.

FIG. 1 is a partial cross-sectional view of the present invention dual telescope whip antenna of FIG. 2. The dual telescopic whip antenna has a radiator 202 that includes a conductive wire 204 having a length 206, a proximal end 208, and a distal end 210. A first telescoping tube section 212 has a length 214, an orifice at a first end 216 to accept the wire proximal end 208, and an antenna port at a second end 218. The antenna port can be any convention means known in the art of connecting to an antenna. For example, the antenna port can be formed as a conductive plug that becomes a pressure-fit connection in a stopper channel assembly. A second telescoping tube section 220 has a length 222 and an orifice at a first end 224 to accept the wire distal end. The second tube 220 has a second end 226. The radiator is shown in the extended position with a length 228 that is approximately equal to the sum of the wire length 206, the first tube length 214, and the second tube length 222. In some aspects, the wire 204 is a nickel titanium material, and the first and second tubes 212/220 are a stainless steel material.

Figure 3:
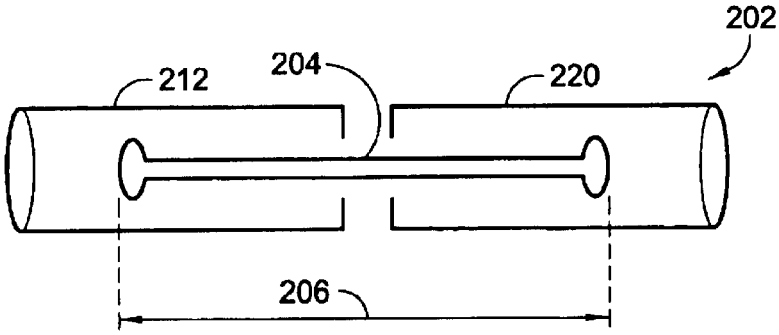
FIG. 3 is a partial cross-section view of the dual telescope whip antenna in the contracted, or withdrawn position.

FIG. 3 is a partial cross-section view of the dual telescope whip antenna in the contracted, or withdrawn position. The radiator 202 has a contracted position with the wire length 206 substantially withdrawn in the first and second tubes 212/220.

Figure 4:
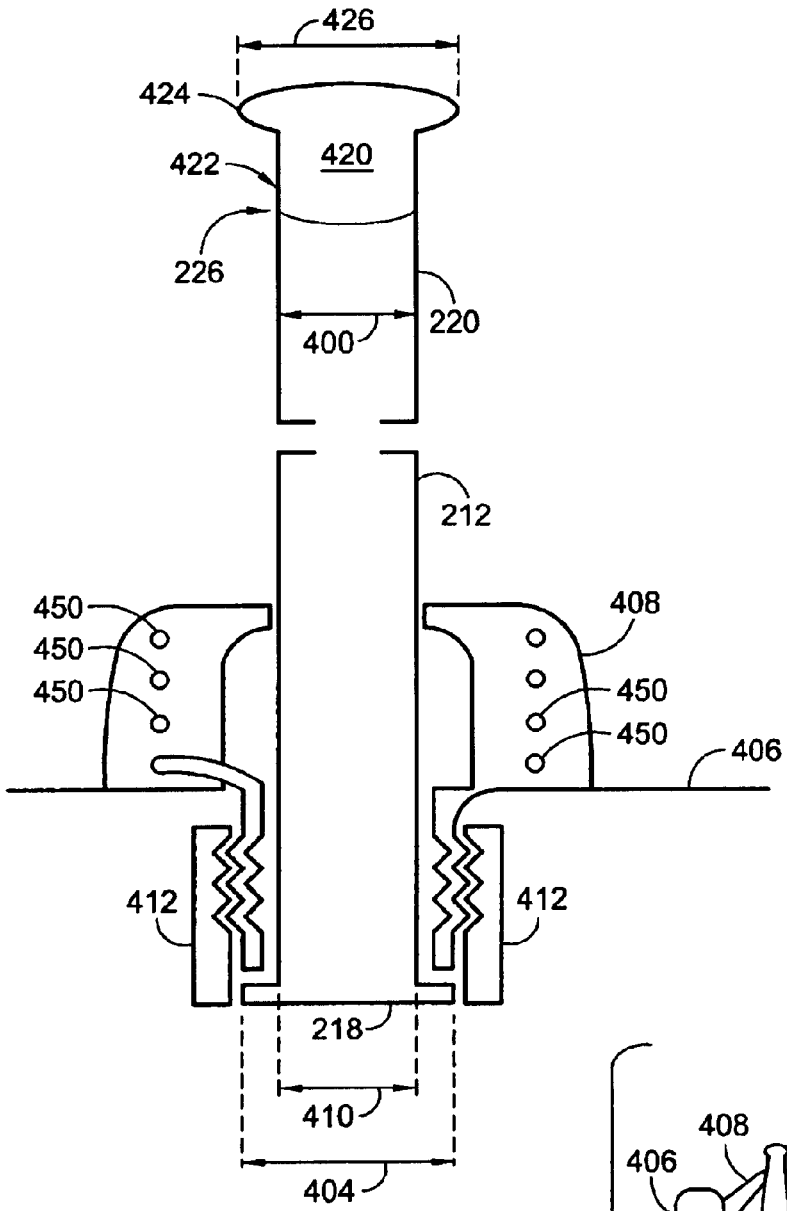
FIG. 4 is a partial cross-sectional view featuring the chassis stopper channel.

FIG. 4 is a partial cross-sectional view featuring the chassis stopper channel. In some aspects of the system, the first and second tubes 212/220 have a first diameter 400. However, the tube diameters need not necessarily be identical. The first tube second end 218 is shown formed as a butt having a second diameter 404 greater than the first diameter (the diameter of the first tube 212). A chassis 406 is shown with a stopper channel assembly 408 with a stopper channel having a third diameter 410 less than the second diameter 404. More specifically, the stopper channel assembly is shown formed with a threaded section mating to a nut 412. The nut 412 can be connected with a spring clip to the transmission line second end (see FIG. 2), not shown, and acts as the transmission line terminal. Alternately, the stopper channel assembly can be formed as a conductive snap that is pressure fit inside the chassis 406 against a transmission line terminal. There are many other conventional means of securing a stopper channel assembly 408 to a chassis 406 that are not described, but which would be suitable for use with the present invention.

There are many conventional antenna/transmission line interfaces that would be practical for use with the present invention system. The transmission line connected to the nut 412 can be a coax cable, microstrip, stripline, or any conventional transmission line. The ground polarity of the transmission line is typically connected to a circuit board or chassis section ground (not shown) that acts as a counterpoise to the radiator.

The first tube antenna port at the second end 218 is connected to the transmission line, through the nut 412, in the radiator extended position. The stopper channel assembly 408 accepts the first and second tubes 212/220 in the radiator contracted position. The stopper channel 408 assembly, as shown, limits the extension of the first tube 212 from the chassis 406 in the radiator extended position.

Figure 5:
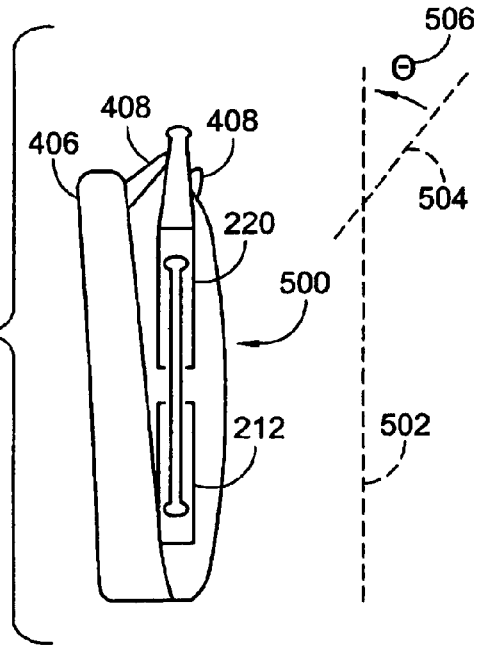
FIG. 5 is a partial cross-sectional view of the present invention radiator withdrawn in a chassis collection channel.

FIG. 5 is a partial cross-sectional view of the present invention radiator withdrawn in a chassis collection channel. The chassis 406 includes a collection channel 500 intersecting the stopper channel to accept the first and second tubes in the contracted position. Reference designator 502 represents the orientation of the collection channel and reference designator 504 represents the orientation of the stopper channel. The angle formed at the intersection (θ) 506 can be greater than zero degrees because of the greater flexibility of the dual telescope sections 212 and 220. Depending on factors such as the diameter of the stopper channel, the diameter of the stopper channel, the outside diameters of the telescope tubes, and the flexibility of the tubes, the angle 506 can be greater than 1 degree. In some aspects, the angle 506 can be greater than 5 degrees.

As seen in FIG. 4, a protective cap 420 has a first end 422 attached to a second end 226 of the second tube 220. The cap 420 includes a second end with a stop 424 having a fourth diameter 426 greater than the second diameter 410. The interface between the stopper channel 408 and the stop 424 can limit the insertion of the second 220 tube into the chassis 406 when the radiator is in the contracted position.

Returning to FIG. 1, the wire distal end 210 is formed in a butt 240 having a fifth diameter 242 and the wire proximal end 208 is formed in a butt 244 having a sixth diameter 246. Note, the fifth diameter 242 may equal the sixth diameter 246 in some aspects. The first tube first end 216 orifice has a diameter 248 less than the sixth diameter 246 to limit the extension of the wire 204 in the radiator extended position. Likewise, the second tube first end 224 orifice has a diameter 250 less than the fifth diameter 242 to limit the extension of the wire 204 in the radiator extended position.

The first tube second end 218 has an interior channel diameter less than the sixth diameter 246 to limit the withdrawal of the wire 204 into the first tube 212, when the radiator is in the contracted position. In the extreme case as shown, the first tube second end is completely sealed. Likewise, the second tube second end 226 has an interior channel diameter 254 less than the fifth diameter 242 to limit the withdrawal of the wire 204 into the second tube 220 when the radiator is in the contracted position. In some aspects, the second end 226 is sealed, or partially sealed by the cap (see FIG. 4).

Returning to FIG. 4, in some aspects of the system the stopper channel includes a helical antenna 450 connected to the transmission line terminal (nut) 412 when the radiator is in the contracted position. The helical antenna 450 is shown as a coil in cross-section. In some aspects of the system (not shown), the helical antenna 450 is disconnected when the dual telescopic whip antenna is extended.

Figure 6:
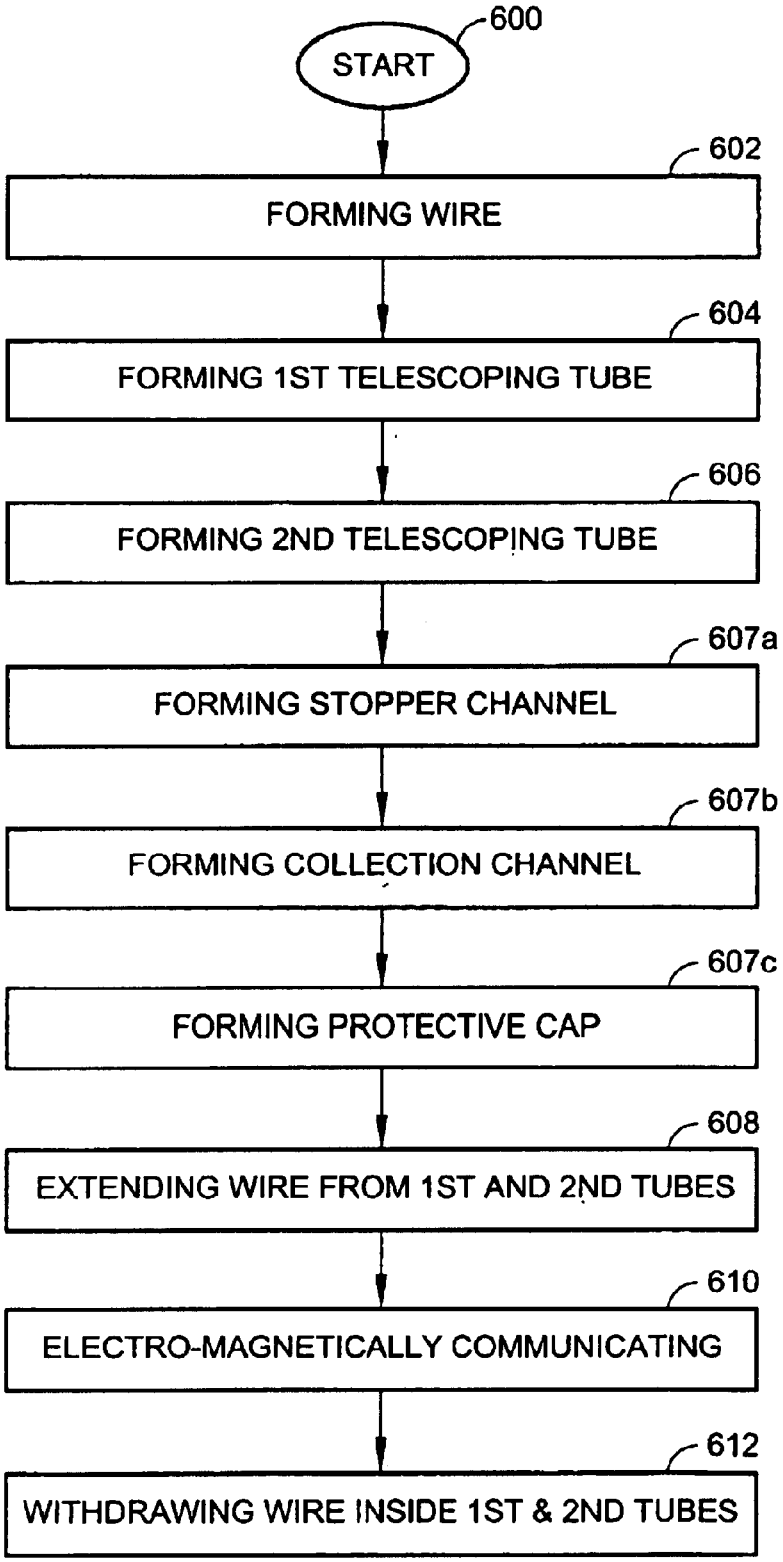
FIG. 6 is a flowchart illustrating the present invention dual telescopic whip antenna method.

FIG. 6 is a flowchart illustrating the present invention dual telescopic whip antenna method. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The methods start at Step 600. Step 602 forms a conductive wire having a length. Step 604 forms a first telescoping tube having a length, an orifice at a first end to accept the wire, and an antenna port at a second end. Step 606 forms a second telescoping tube having a length and an orifice at a first end to accept the wire. Step 608 extends the wire from the first and second tubes to form an extended radiator having a length that is approximately equal to the sum of the wire length, the first tube length, and the second tube length. Step 610 electro-magnetically communicates at an operating frequency such as 824 to 894 megahertz (MHz), 1565 to 1585 MHz, or 1850 to 1990 MHz. Step 612 withdraws the wire length substantially inside the first and second tubes to form a contracted radiator.

In some aspects Step 607*a* forms a chassis stopper channel having a diameter. Then, withdrawing the wire length in Step 612 includes accepting the first and second tubes through the stopper channel. Extending the wire in Step 608 includes using the stopper channel to limit the extension of the first tube from the chassis.

In other aspects of the method Step 607*b* forms a collection channel intersecting the stopper channel to accept the first and second tubes when the radiator is contracted. Typically, the chassis channel intersects the stopper channel at an angle of greater than 1 degree. In some aspects the chassis channel intersects the stopper channel at an angle of greater than 5 degrees.

In some aspects Step 607*c* forms a protective cap having a first end attached to the second tube. Then, withdrawing the wire length in Step 612 includes using the cap to limit the insertion of the second tube into the chassis when the radiator is contracted.

In other aspects, forming a conductive wire in Step 602 includes forming a butt on each wire end. Then, extending the wire in Step 608 includes using the first tube first end orifice and the second tube first end orifice to limit the extension of the wire butt ends from the first and second tubes when the radiator is extended.

In some aspects forming a first tube in Step 604 includes forming a first tube with a second end having a diameter. Forming a second tube in Step 606 includes forming a second tube with a second end having a diameter. Then, withdrawing the wire length in Step 612 includes using the first and second tube second end diameters to limit the insertion of the wire butt ends into the first and second tubes when the radiator is contracted.

A dual telescopic antenna system and method have been presented. Specific examples of an antenna system have been given in the context of a wireless telephone device, but the invention is not necessarily so limited. Further, although only two telescoping sections have been specifically described, the present invention concept is applicable to multiple telescopic sections. Other variations and embodiments of the invention will occur to those skilled in the art.

I claim:

1. A dual telescopic whip antenna comprising:

a radiator including:

a conductive wire having a length, a proximal end, and a distal end;

a first telescoping tube section having a length and a first diameter, an orifice at a first end to accept the wire proximal end, and an antenna port at a second end attached to a butt having a second diameter greater than the first diameter;

a second telescoping tube section having a length, a first diameter, and an orifice at a first end to accept the wire distal end;

wherein the radiator has an extended position length that is approximately equal to the sum of the wire length, the first tube length, and the second tube length, and a contracted position with the wire length substantially withdrawn in the first and second tubes; and, the antenna further comprising:

a chassis including:

a stopper channel assembly with a stopper channel having a third diameter less than the second diameter to accept the first and second tubes in the radiator contracted position and to limit the extension of the first tube from the chassis in the radiator extended position, and a transmission line terminal connected to the first tube antenna port in the radiator extended position; and, a collection channel intersecting the stopper channel at an angle of greater than 5 degrees, to accept the first and second tubes in the contracted position.

2. The antenna of claim 1 further comprising:

a protective cap having a first end attached to a second end of the second tube.

3. The antenna of claim 2 wherein the cap includes a second end with a stop having a fourth diameter greater than the second diameter; and, wherein the interface of the stopper channel and the stop limits the insertion of the second tube into the chassis when the radiator is in the contracted position.

4. The antenna of claim 3 wherein the wire distal end is formed in a butt having a fifth diameter and wherein the wire proximal end is formed in a butt having a sixth diameter;

wherein the first tube first end orifice has a diameter less than the sixth diameter to limit the extension of the wire in the radiator extended position; and, wherein the second tube first end orifice has a diameter less than the fifth diameter to limit the extension of the wire in the radiator extended position.

5. The antenna of claim 4 wherein the first tube second end has an interior channel diameter less than the sixth diameter to limit the withdrawal of the wire into the first tube when the radiator is in the contracted position; and, wherein the second tube second end has an interior channel diameter less than the fifth diameter to limit the withdrawal of the wire into the second tube when the radiator is in the contracted position.

6. The antenna of claim 1 wherein the wire is a nickel titanium material.

7. The antenna of claim 1 wherein the first and second tubes are a stainless steel material.

8. The antenna of claim 1 in which the antenna has an operating frequency selected from the group including 824 to 894 megahertz (MHz), 1565 to 1585 MHz, and 1850 to 1990 MHz.

9. A wireless communications device dual telescopic antenna system, the system comprising:

a wireless communications transceiver having a communications port;

a transmission line having a first end connected to the transceiver communications port, and a second end;

a dual telescopic whip antenna radiator including:

a conductive wire having a length, a proximal end, and a distal end;

a first telescoping tube section having a length and a first diameter, an orifice at a first end to accept the wire proximal end, and an antenna port at a second end attached to a butt having a second diameter greater than the first diameter;

a second telescoping tube section having a length, a first diameter, and an orifice at a first end to accept the wire distal end;

wherein the radiator has an extended position length that is approximately equal to the sum of the wire length, the first tube length, and the second tube length, and a contracted position with the wire length substantially withdrawn in the first and second tubes; and, the antenna further comprising:

a chassis including:

a stopper channel assembly with a stopper channel having a third diameter less than the second diameter to accept the first and second tubes in the radiator contracted position and to limit the extension of the first tube from the chassis in the radiator extended position and a transmission line terminal connected between the transmission line second end and the first tube antenna port in the radiator extended position; and, a collection channel intersecting the stopper channel at an angle of greater than 5 degrees, to accept the first and second tubes in the contracted position.

10. The system of claim 9 further comprising:

a protective cap having a first end attached to a second end of the second tube.

11. The system of claim 10 wherein the cap includes a second end with a stop having a fourth diameter greater than the second diameter; and, wherein the interface of the stopper channel and the stop limits the insertion of the second tube into the chassis when the radiator is in the contracted position.

12. The system of claim 11 wherein the wire distal end is formed in a butt having a fifth diameter and wherein the wire proximal end is formed in a butt having a sixth diameter;

wherein the first tube first end orifice has a diameter less than the sixth diameter to limit the extension of the wire in the radiator extended position; and, wherein the second tube first end orifice has a diameter less than the fifth diameter to limit the extension of the wire in the radiator extended position.

13. The system of claim 12 wherein the first tube second end has an interior channel diameter less than the sixth diameter to limit the withdrawal of the wire into the first tube when the radiator is in the contracted position; and, wherein the second tube second end has an interior channel diameter less than the fifth diameter to limit the withdrawal of the wire into the second tube when the radiator is in the contracted position.

14. The system of claim 9 wherein the stopper channel includes a helical antenna connected to the transmission line terminal when the radiator is in the contracted position.

15. The system of claim 9 wherein the wire is a nickel titanium material.

16. The system of claim 9 wherein the first and second tubes are a stainless steel material.

17. The system of claim 9 in which the antenna has an operating frequency selected from the group including 824 to 894 megahertz (MHz), 1565 to 1585 MHz, and 1850 to 1990 MHz.

18. A dual telescopic whip antenna method, the method comprising:

forming a conductive wire having a length;

forming a first telescoping tube having a length, an orifice at a first end to accept the wire, and an antenna port at a second end;

forming a second telescoping tube having a length and an orifice at a first end to accept the wire;

forming a chassis stopper channel having a diameter;

forming a collection channel intersecting the stopper channel at an angle of greater than 5 degrees, to accept the first and second tubes when the radiator is contracted;

extending the wire from the first and second tubes to form an extended radiator having a length that is approximately equal to the sum of the wire length, the first tube length, and the second tube length, by using the stopper channel to limit the extension of the first tube from the chassis; and, withdrawing the wire length substantially inside the first and second tubes to form a contracted radiator by accepting the first and second tubes through the stopper channel.

19. The method of claim 18 further comprising:

forming a protective cap having a first end attached to the second tube; and, wherein withdrawing the wire length includes using the cap to limit the insertion of the second tube into the chassis when the radiator is contracted.

20. The method of claim 19 wherein forming a conductive wire includes forming a butt on each wire end; and, wherein extending the wire includes using the first tube first end orifice and the second tube first end orifice to limit the extension of the wire butt ends from the first and second tubes when the radiator is extended.

21. The method of claim 20 wherein forming a first tube includes forming a first tube with a second end having a diameter;

wherein forming a second tube includes forming a second tube with a second end having a diameter; and, wherein withdrawing the wire length includes using the first and second tube second end diameters to limit the insertion of the wire butt ends into the first and second tubes when the radiator is contracted.

22. The method of claim 18 further comprising:

electro-magnetically communication at an operating frequency selected from the group including 824 to 894 megahertz (MHz), 1565 to 1585 MHz, and 1850 to 1990 MHz.

* * * * *